United States Patent [19]

Laird, Jr.

[11] 4,098,624

[45] Jul. 4, 1978

[54] PROCESS FOR INCREASING THE VERSATILITY OF ISOTHERMAL TRANSFORMATION

[75] Inventor: W. James Laird, Jr., Sterling Heights, Mich.

[73] Assignee: Upton Industries, Inc., Roseville, Mich.

[21] Appl. No.: 754,921

[22] Filed: Dec. 28, 1976

[51] Int. Cl.[2] ..... C21D 1/18; C22F 1/04; C22F 1/18

[52] U.S. Cl. ..... 148/153; 148/155; 148/158; 148/159; 214/1 BD; 214/152

[58] Field of Search ..... 148/149, 153, 155, 156, 148/157, 158, 159, 160, 161, 162; 214/1 BD, 152

[56] References Cited

U.S. PATENT DOCUMENTS

| | | | |
|---|---|---|---|
| 2,862,843 | 12/1958 | Engelhard | 148/149 |
| 3,459,313 | 8/1969 | Upton et al. | 214/1 BD |
| 3,558,367 | 1/1971 | Eck | 148/149 |

*Primary Examiner*—R. Dean
*Attorney, Agent, or Firm*—Cullen, Settle, Sloman & Cantor

[57] ABSTRACT

An isothermal transformation process or method is disclosed for heat treating metals of the class which is characterized by having a time-temperature-transformation, or T-T-T Diagram or Isothermal Transformation Diagram. The process includes the steps of heating the metal workpiece at a heating source or station to a temperature above the solution treating transformation or austenitizing temperature ($A_1$) where the workpiece is formed into a homogeneous solid solution; thereafter encapsulating the workpiece in a generally closed container which maintains the temperature of the workpiece above the aforesaid solution treating transformation or austenitizing temperature during the period of time required to physically transport the container and the workpiece therein from the heating source or station to a cooling source or station; transporting the container with the workpiece therein to the cooling source or station; removing the workpiece from the container; and immediately inserting the workpiece which still has a temperature above the solution treating transformation or austenitizing temperature into a cooling source or station which thereafter performs the isothermal transformation of the workpiece and where the homogeneous solid solution is converted by cooling to the desired mixed solids.

30 Claims, 9 Drawing Figures

FIG. 2
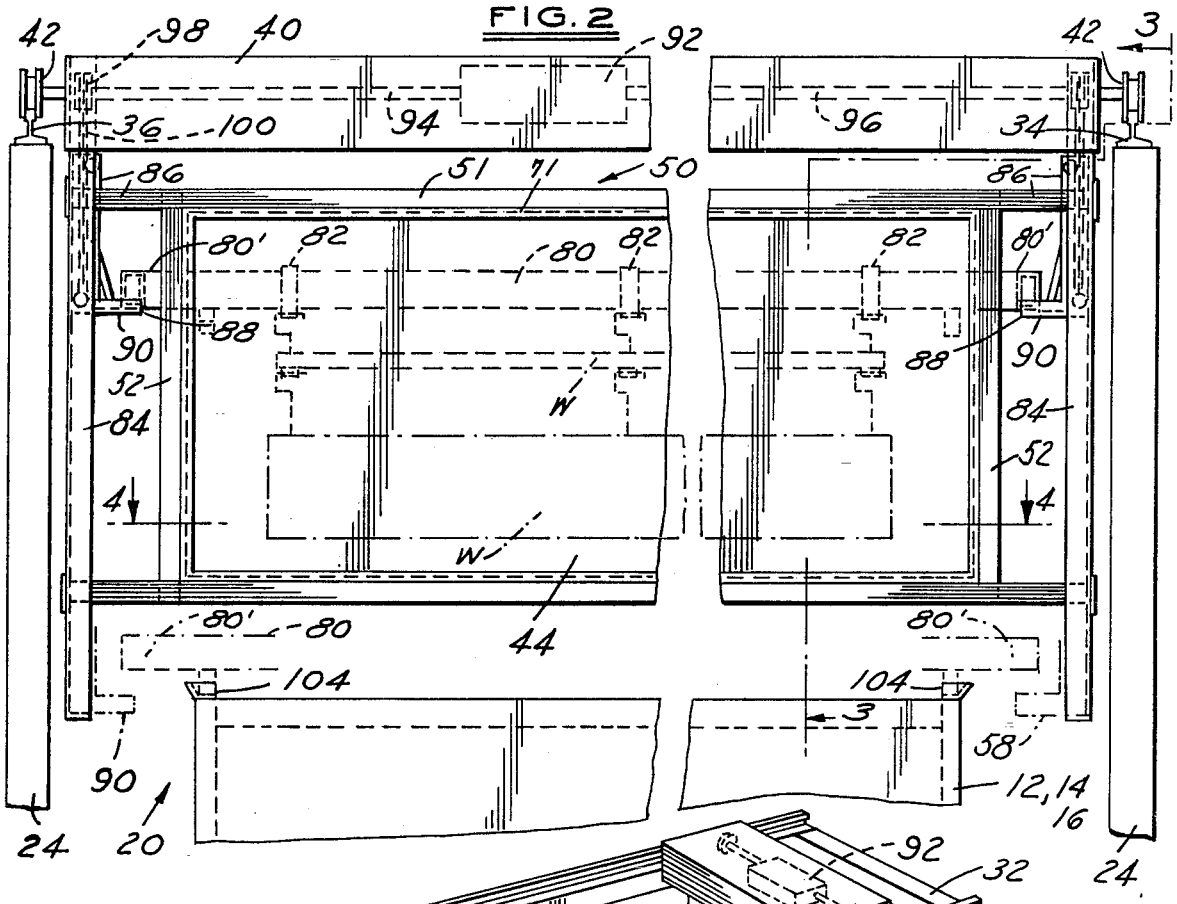
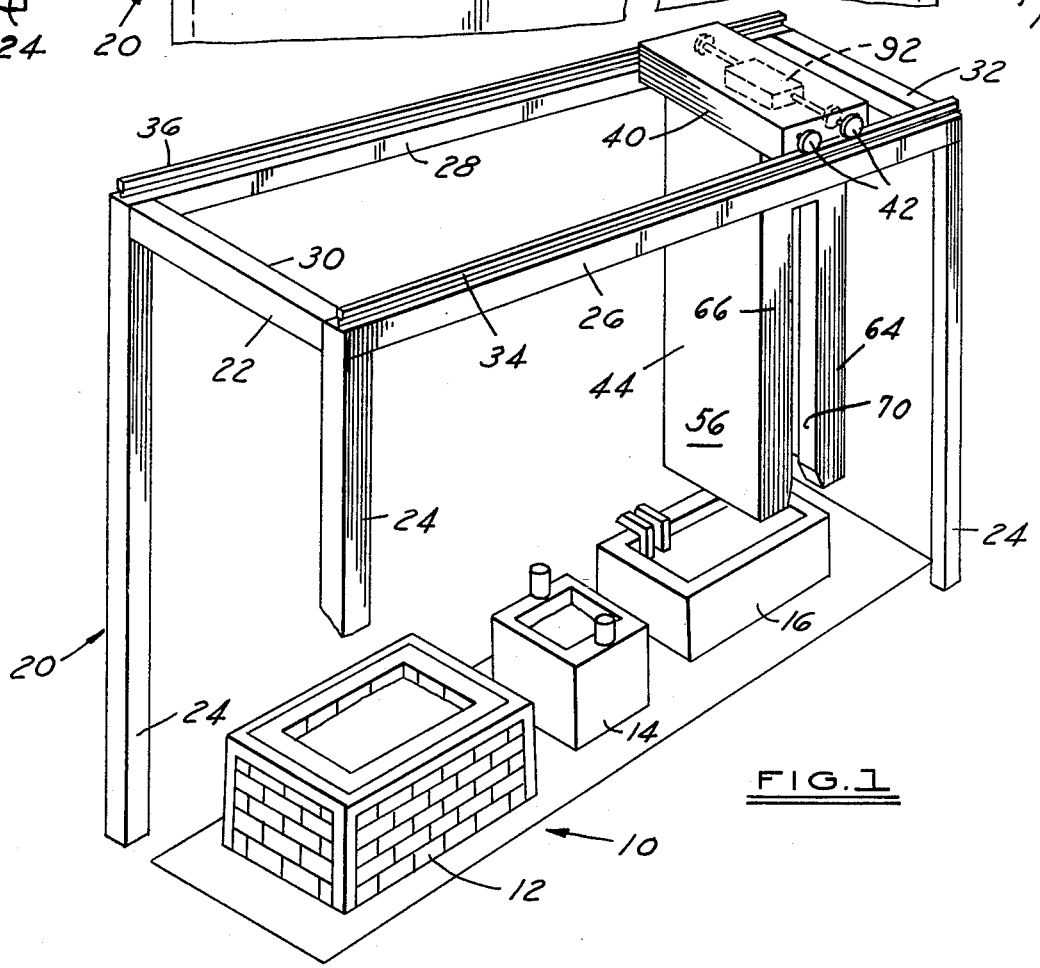
FIG. 1

MAR-QUENCHING

AUS-TEMPERING

PROCESS FOR INCREASING THE VERSATILITY OF ISOTHERMAL TRANSFORMATION

BACKGROUND OF THE INVENTION

1. Field of the Invention

This invention relates to the art or process of heat treating metal parts or workpieces for industrial applications using the well known isothermal transformation technique resulting in improved physical and chemical characteristics of the workpieces and is particularly applicable to such a process which is automated or semi-automated for handling metal parts or workpieces of various size, shape, mass, geometry, chemical composition and thermo-property.

2. Description of the Prior Art

Heat treating of metals to achieve desired chemical and physical properties, in many cases, requires the isothermal decomposition of metallurgical constituents. This process is achieved by first heating the metal above the solution treating transformation or austenitizing temperature $A_1$ where, given enough time, a homogeneous solid solution is formed. In the case of steel it is seen from the iron-cementite phase of the Isothermal Transformation Diagram that an eutectoid composition transforms completely, in time, to austenite at 1333° F. In normal heat treating practice, to be sure all sections of each workpiece and all workpieces are above the $A_1$ temperature, the workpieces will be heated to a temperature above the $A_1$ while eutectoid steel will be heated to around 1500° F. After achieving solid solution by heating the workpiece to a temperature above the $A_1$ temperature for the proper amount of time, the solid solution is converted by cooling to the desired mixed solids. In many cases to achieve the desired mixed solids and to avoid the formation of other mixtures or undesirable proportions of desired mixed solids, it is necessary to super-cool the workpiece from above the $A_1$ temperature. The practice of transporting the workpiece from the heat source or station to the cooling source or station is now being done mechanically as is disclosed and described in the Upton et al U.S. Pat. No. 3,459,313 entitled "Work Transporting Apparatus", assigned to the assignee of record.

In certain heat treating processes, it may be necessary to transfer a workpiece from a furnace to a liquid quench in a matter of seconds, as for example, from one to five seconds. It is difficult to utilize conveyor structures of the mechanical type using hook-type hanger elements for support since the workpieces supported on the hangers would swing and splash when lowered into the liquid quench tank. Swinging is further objectionable because it may cause the workpiece to become disengaged from the conveyor and may also result in the distortion of the workpiece. Even though the mechanical rotary transfer arm apparatus disclosed in U.S. Pat. No. 3,459,313 was an improvement over the hook-type hanger elements just described by providing a transfer device which minimized the swinging of workpieces and permitted the transfer of workpieces from one station to another more rapidly than prior art devices, it nevertheless cannot physically handle various workpieces of certain mass, geometry, size and shape and transport such workpieces from the heating station to the cooling station in the time period available which may be as short as one to five seconds. Thus with the use of mechanical transfer devices, time is of the essence for transferring the workpiece from the heating station to the cooling station.

In the case of molten salt bath heat treating or pit type operations, as an example, using the transfer device disclosed in U.S. Pat. No. 3,459,313, the workpiece is exposed to the cooling effects of the atmosphere which exists between the heating source and the quench or cooling source. To avoid excess cooling of the workpiece during transport, conventional apparatuses, employing speed of movement alone, are used which quickly transport the workpiece from one station to another. In many cases, the mass, geometry and/or chemical composition of the workpiece requires a transport time less than mechanically possible by conventional means, to avoid cooling below the $A_1$ temperature thus, limiting the practical use of the isothermal transformation process to those metals whose mass, geometry and/or chemical composition permits transport in the times required by conventional mechanical devices. Conventional mechanical devices thus do not provide a means by which heat is kept from leaving the workpiece, thereby making it possible for other masses, geometries and/or chemical compositions to have temperatures below the $A_1$ temperature before entering the quench or cooling station. This is undesirable since the desired physical and chemical properties of the workpieces are not obtained resulting in scrap or inferior products.

Various devices have been disclosed for heat treating parts by enclosing the workpiece in a shield; however such shield has not been used for increasing the versatility of isothermal transformation of metal workpieces as disclosed herein. A preliminary novelty search resulted in the following United States patents: U.S. Pat. No. 2,142,139 of A. W. Machlet, dated Jan. 3, 1939; U.S. Pat. No. 2,417,610 of H. P. Phillips, dated Mar. 18, 1947; U.S. Pat. No. 2,862,843 of W. E. Engelhard, dated Dec. 2, 1958; U.S. Pat. No. 3,415,694 of W. E. Engelhard, dated Dec. 10, 1968; and U.S. Pat. No. 3,972,751, of W. E. Engelhard, dated Aug. 3, 1976. However, none of the prior art devices or methods are directed to preventing the temperature of the metal workpieces from falling below the $A_1$ or solution treating transformation temperature during transportation of the workpieces from the heating station to the cooling station or to products which have improved metallurgical and physical properties achieved by processes like the austempering and mar-quenching techniques and are obtained economically, thus eliminating waste and scrap.

SUMMARY OF THE PRESENT INVENTION

It is a feature of the present invention to provide a method of increasing the versatility of the isothermal transformation process by eliminating the critical time requirement or factor now required when transporting workpieces from one station to another when heat treating metal workpieces requiring isothermal transformation to achieve the desired metallurgical properties. While a period of time is required to move or transport the workpieces from the heating station to the cooling station, such time period is no longer critical or of the essence in obtaining products or workpieces having the required metallurgical properties.

The process of the present invention requires keeping the temperature of the workpiece above the solution treating transformation or austenitizing temperature ($A_1$) during the period of time required to transport the workpiece from the heating source or station, which will perform the isothermal transformation of the workpiece. Keeping the temperature of the workpiece above the solution treating transformation or austenitizing temperature during transport, may be carried out with the aid of many mechanical devices, depending on the mass, geometry, and/or chemical composition of the workpiece, and the ability of the workpiece to lose heat. Mechanical devices to accomplish the invention, will vary from simple envelopment of the parts as they leave the heat source to protect the workpiece from effects of the atmosphere found between the heating and cooling sources, to the supplying of heat to the workpiece through a mechanical device during the time in which the workpiece is being transported from the heat source to the cooling source, thus, assuring the workpiece temperature remaining above the solution treating transformation or austenitizing temperature during transport. Insulation, heating elements or reflectors may be used in the shields or containers housing the workpieces to assist in maintaining the temperature above to the solution treating transformation temperature.

Thus, a further feature of the present invention is to avoid cooling of the workpiece below the solution treating transformation austenitizing temperature ($A_1$) during transport from the heating source or station to the cooling source or station. The present invention thereby permits and makes practical long periods of time to be used to transport the workpiece from the heat source to the quench or cooling source by holding the temperature above the solution treating transformation temperature of the workpiece. The present invention may be accomplished with the use of a variety of mechanical devices; these mechanical devices enclosing the workpiece as it leaves the heat source and maintaining the temperature of the workpiece above the solution treating transformation or austenitizing temperature ($A_1$) until the workpiece enters the quench. The selection of the device to be used to carry out the invention will depend on the mass, geometry, chemical composition, and thermo-properties of the workpiece.

BRIEF DESCRIPTION OF THE DRAWINGS

FIG. 1 is a perspective view of a heat treating apparatus having a series of stations;

FIG. 2 is an end view of the heat treating apparatus showing the insulated shield or container in a raised position and in a lowered position relative to a station;

DESCRIPTION OF THE PREFERRED EMBODIMENT

Figure 3:
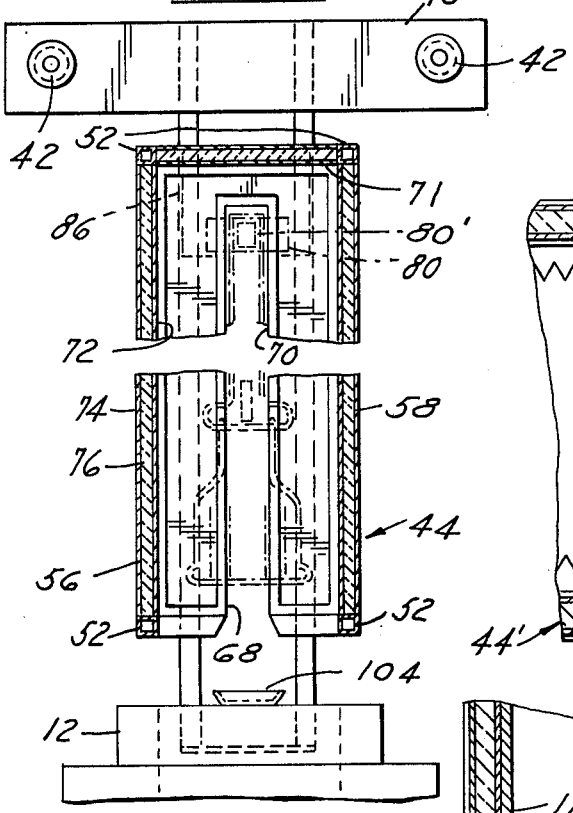
FIG. 3 is a sectional view taken on the line 3—3 of FIG. 1.

Referring now to the drawings, FIG. 1 illustrates a heat treating system 10 including a plurality of stations arranged in line and including, as an example, a solution treating transformation or austenitizing furnace or heat treat furnace or heating station 12, a quench or cooling station 14 and a tempering or aging station 16. It should be appreciated, however, that the present invention may be used with any heat treating system having additional stations such as described in the Upton et al. U.S. Pat. No. 3,459,313 and as is further well known in the art. The system 10 may be used with the austempering or mar-quenching processes as applied to ferrous metals to be subsequently described or with a solution treating and aging process or technique as applied to non-ferrous metals such as aluminum, aluminum alloys, titanium and titanium alloys.

The heat treating furnace 12 may, as an example, be either gas-fired or electrically operated and preferably contains a molten salt bath where the heat treating job requires temperatures ranging from 350° F. to 2400° F. although furnaces of the atmosphere type may be used in certain applications.

Typical molten salt bath electric furnaces are disclosed in the following patents assigned to the assignee of record: U.S. Pat. Nos. 2,223,138, dated Nov. 26, 1940; 2,223,139; dated Nov. 26, 1940; 2,355,761 dated Aug. 15, 1944; 2,464,008, dated Mar. 8, 1949; 3,049,576, dated Aug. 14, 1962; and 3,420,937, dated Jan. 7, 1969.

In salt baths, heating is even because a uniform temperature is maintained throughout the molten salt. In other types of heat treating furnaces, uneven distribution of heat causes problems. Some areas of the work heat up more rapidly than other areas, causing distortion. Salt baths also minimize distortion by preheating the work automatically. As a cold part enters the bath it becomes enveloped in a cocoon of frozen salt. Although this cocoon melts in about one minute it acts as a protective shield until the work has been safely preheated. Thereafter the workpiece is heated rapidly to the temperature of the bath. The rate of heating is limited only by the conductivity of the metal itself and by the ability of furnace to supply energy at a rate fast enough to maintain the bath temperature. A salt bath is preferred since the rate of heating is considerably faster than in furnaces heated by radiation or gaseous convection, because in molten salt the workpiece is heated by conduction only. Also for most work, time cycles can be employed that are from one-fourth to one-fifth as long as those normally used for heating the same workpieces in furnaces of the atmosphere type.

The cooling station or quench tank 14 contains a quenchant. Many quenchants can be used with varying degrees of success such as water, brine solutions, oil, air (in special cases), sodium hydroxide solutions, caustic solutions and molten salt as is well known in the art. The rate at which a workpiece cools is determined by the characteristic of the quenching medium, the quenching temperature, degree of agitation and size of the workpiece. Heat is abstracted from the workpiece by cooling the surface. Quenching severity is a measure of how fast heat is removed. The cooling power or quenching severity of the preferred molten salt or brine solution bath is increased by agitation. When salt baths are used for marquenching and austempering, the station is provided or equipped with pumps or propellers to create the required disturbance. With the present invention a molten salt or brine solution is preferred as is now used in the art when austempering or marquenching. It has been determined that with a salt distortion of the workpiece is minimal, and the workpiece, when made from steel or an alloy thereof, is endowed with higher, more uniform hardness and greater toughness and ductility.

The tempering station 16 is of a conventional type and contains a salt bath for tempering the workpiece after removal from the cooling station 14.

The molten salt baths referred to herein and used at the cooling and tempering stations may contain an eutectic mixture of two or more salts taken from nitrates and nitrides of sodium and potassium ($N_2NO_2$,Na $NO_3$, $KNO_3$ and $KNO_2$ as is well known in the art.

The present invention relates to the concept of increasing the number of groups of metals, both in mass and chemistry that can, as an example, be austempered or mar-quenched by encasing or enveloping a metal workpiece, heated in the heat treating furnace 12, within an insulating container during the time that the metal workpiece is being transferred from the furnace 12 to the cooling station 14 so as to maintain the temperature level of the workpiece at the level characteristic of the furnace.

The apparatus utilized to encapsulate the workpiece and to transfer same at the required temperature may take various forms and the drawings illustrate one apparatus, designated by the numeral 20, for carrying out the invention.

The apparatus 20 includes a stationary rectangular frame 22 mounted above the stations 12, 14 and 16 by means of four or more posts 24 located at the corners of the frame 22 and elevating same above the stations. The frame 22 comprises a pair of parallel longitudinally extending structural bars or members 26, 28 which are spaced apart and are connected at the ends thereof by structural members 30, 32. Mounted on the structural members 26, 28 are a pair of rails 34, 36 which extend the entire length of members 26, 28 respectively. The rails 34, 36 are suitably fixed to the members 26, 28 and are stationary.

The apparatus 20 further includes a movable carrier, dolly, bridge crane, cantilevered dolly or robot 40. The robot 40 has at each side thereof a pair of rollers 42 engageable with the rails 34, 36. The robot 40 has depending therefrom a generally closed insulated housing, sleeve or container 44 to be subsequently described. Thus the robot or carrier 40 and housing 44 are moved as a unit along the tracks or rails 34, 36 from one end to the other end to position the housing or container 44 relative to a selected treating station 12, 14, 16. The carrier 40 and housing 44 may be moved manually on the rails 34, 36 or may be operated automatically or semi-automatically by electrical controls, not shown.

Figure 4:
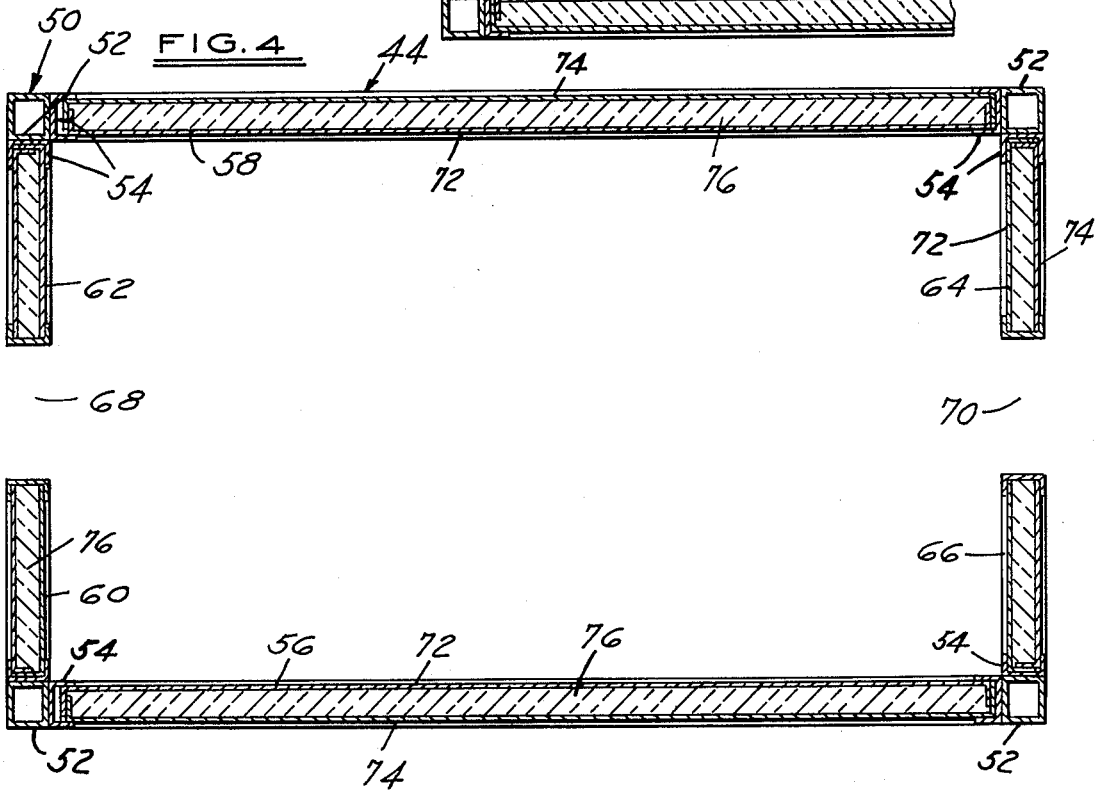
FIG. 4 is a sectional view taken on the line 4—4 of FIG. 1.

The insulated sleeve or housing 44, as shown in FIG. 4, includes, as an example, a frame 50 having tubular corner and frame members 52 which include means 54 for holding and securing a plurality of insulated panel members 56, 58, 60, 62, 64 and 66. In sleeve or housing 44, the panel members 56, 58 form the front and back sides of the housing 44. Panel members 60 and 62 form one side of the housing 44 while panel members 64 and 66 form the other side of the housing 44. The opposing edges of panel members 60 and 62 and of panel members 64 and 66 are spaced apart to form entrances or openings 68 and 70 respectively. An insulated panel member 71 (FIG. 3) extends across the top of the sleeve 44.

Each panel member may include one or a plurality of panels arranged in an edge to edge abutting relationship and consists of a pair of spaced apart metal or steel panels 72, 74 having suitable insulating material 76 therebetween. Insulating material 76 may be one of any of the many well known materials used for insulating purposes in the heat treating field.

The apparatus 20 includes a vertically movable work support or carrier bar 80 (FIG. 2) movable within the interior of the sleeve or housing 44 and provided with end portions 80' which extend through the openings 68 and 70 provided in the sleeve 44. The carrier bar 80 is elongated and is of tubular construction. A plurality of work fixtures or hangers 82 are adjustably mounted on the carrier bar 80 to carry the workpieces W. The carrier bar 80 has a raised position in the sleeve or housing 44 and a lowered position where it is located at a station exteriorly of the housing 44 as shown in FIG. 2.

The apparatus 20 includes at the ends thereof as shown in FIG. 2 a pair of stationary tracks or channels 84 for components of the lifting or elevating mechanism. The sleeve 44 may be carried by a vertically movable cross member 86 having at the ends thereof a pair of supports 88 provided with horizontally extending work support arms 90 which are adapted to engage and guide the work support or carrier bar 46 during its vertical movement.

A reversible motor 92 is connected at opposite ends to a pair of shafts 94, 96 for driving or rotating same. Each shaft 94, 96 has at the opposite ends thereof a sprocket 98 (FIG. 2). A chain 100 is appropriately wrapped around each sprocket 98 and is connected to a suitable pulley or the like for raising or lowering the supports 88 and arms 90 and thus the carrier bar 80. Energization of the motor 92 is effective to rotate the shafts 94, 96 so as to in turn rotate the sprockets 98 and move the chains 100 to thereby raise or lower the work support or carrier bar 80 and the workpieces W.

When the carrier bar 80 is in the lowered position (FIG. 2), the carrier bar 80 engages and rests upon the work support saddle 104 provided at each station. The saddle 104 supports the carrier bar 80 and the workpieces W carried by it. Thereafter, the arms 90 move away from the carrier bar 80 and the robot 40 may be moved to another station or remain at the selected station.

Figure 5:
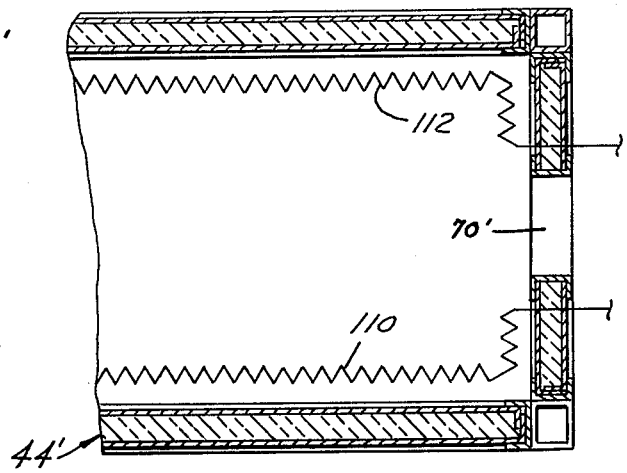
FIG. 5 is a fragmentary sectional view showing a modified insulated container provided with heating elements.

FIG. 5 illustrates a modification of the sleeve 44 and is designated by the numeral 44' which includes electrical heating coils 110, 112 which are connected to a source of electrical energy, not shown, for supplying additional energy or heat to the insulated sleeve 44' to maintain the temperature of the sleeve 44' above the solution treating transformation temperature.

Figure 6:
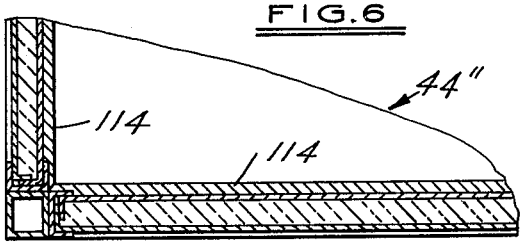
FIG. 6 is a fragmentary sectional view showing still another modified insulated container provided with reflectors.

FIG. 6 illustrates a modification of the sleeve 44 and is designated by the numeral 44''. It includes around the inside of the sleeve 44' panels 114 of metal or other materials which are polished, as an example, stainless steel, to reflect the heat radiated from the workpieces W back into the workpiece to assist in maintaining the temperature of the sleeve 44'' above the solution treating transformation temperature.

The importance and use of isothermal transformation diagrams to heat treating techniques and in particular when austempering and mar-quenching of ferrous metals is well known. Such diagrams including the analysis and function thereof are set forth in the "Atlas of Isothermal Transformation Diagrams", Copyright 1951 by United States Steel Corporation (Second Edition, 4th Printing, 1961); "The Making, Shaping and Treating of Steel" by J. M. Camp and C. B. Francis, Copyright 1940 by Carnegie-Illinois Steel Corporation, (Fifth Edition, Second Impression, October, 1941, rewritten by C. B.

Francis); and in "Heat Treating, Cleaning and Finishing", Volume 2 of Metals Handbook, Eighth Edition, Copyright, 1964 by The American Society For Metals. Included in Volume 2 of Metals Handbook are various T-T-T Diagrams including one for a 7075-T6 aluminum alloy at page 275 and for various steels on pages 17, 37, 38 and 57. The characteristics of titanium are shown on page 301.

Figure 8:
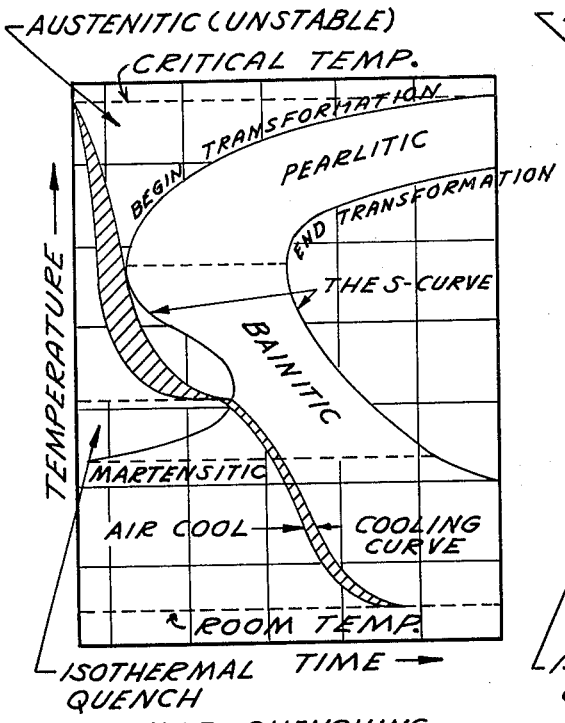
FIG. 8 is a typical T-T-T Diagram illustrating the mar-quenching process for ferrous metals.
Figure 7:
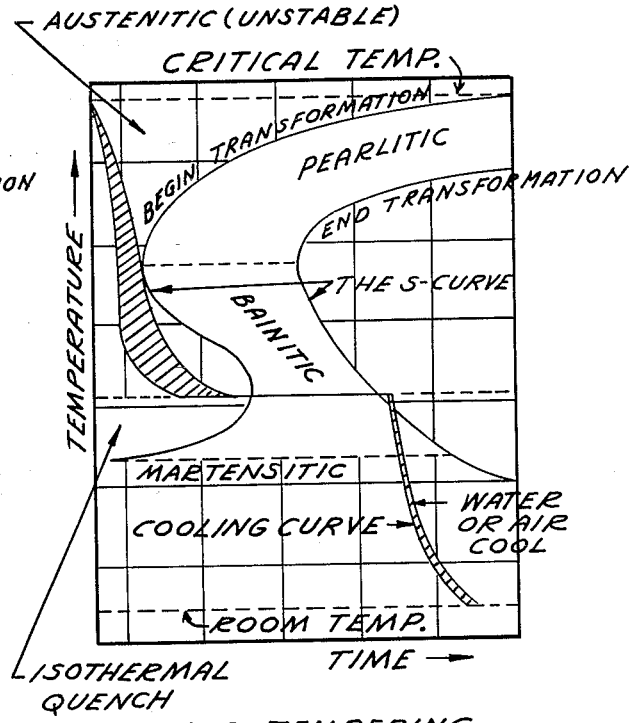
FIG. 7 is a typical T-T-T Diagram illustrating the austempering process for ferrous metals.

In order to clearly explain the present invention to austempering and mar-quenching (martempering), reference is made to the S-curves or T-T-T diagrams, of FIGS. 7 and 8.

In heat treatment the microstructure of the metal workpiece is transformed to obtain desired properties. Essentially, an S-curve comprises two curves, one indicating the beginning of transformation, the other the end of transformation. S-curves are important in determining the rate of cooling required to avoid premature transformation, the time required to obtain a desired structure and the temperature at which the structure is actually obtained.

The shape of the S-curve depends on the chemistry of the steel or other metal, temperature and time, grain size and cooling rate. All these factors affect the displacement of the curve and the start of transformation, which is called the Ms point. The general effect of carbon and most alloying elements of steel is to move the curve to the right, which may permit a milder quench or slower cooling rate than is necessary for a low-carbon or nonalloy steel to achieve an equivalent microstructure. It also lowers the temperature at which certain microstructures such as martensite begin to form. Because it includes time as a factor, the S-curve represents a three-dimensional approach to understanding heat treating problems.

The isothermal process involves heating steel or cast iron metal to cause its constituents to go into solution (austenitizing), or involves heating non-ferrous metals such as aluminum or titanium and alloys thereof to cause its constituents to go into solution by solution treating transformation, and then quenching the metal at or above its critical cooling rate so the material reaches the isothermal quench temperature with no undesirable higher temperature transformation properties.

The quench temperature is indicated by the S-curve for the particular steel or metal being treated. For example, when steel is heated to 1500° F. or so, carbide in the iron dissolves to form austenite. If the austenite in steel with 0.80 percent carbon (eutectoid steel) is cooled to 1200° F. and held at that temperature long enough, it transforms entirely to a soft pearlite microstructure. If however, the cooling rate quickly reduces the austenite to 600° F., pearlite is avoided. Bainite, a much harder microstructure, results. If the cooling rate is sufficiently rapid, formation of both pearlite and bainite is avoided. The microstructure then becomes martensite, the hardest structure that can be produced. When the temperature of the austenite approaches 400° F. martensite begins to form, reaching 90 percent or more at 200° F.

FIG. 7 illustrates the austempering cooling curve in relation to the S-curve. Austenitic steel is cooled at a sufficient rate to avoid the nose of the S-curve and held just above the Ms point for complete transformation to a bainite structure while the temperature remains constant, thereby alleviating thermal stresses that could cause cracking or distortion. Time-temperature diagrams like this one give heat treaters a three-dimensional view of heat treating problems.

FIG. 8 illustrates the mar-quenching cooling curve in relation to the S-curve. Austenitic steel is cooled at a sufficient rate to avoid the nose of the S-curve, preventing start of pearlitic or bainitic transformation. It is then held just above the Ms point (start of transformation) to obtain temperature uniformity. When temperature is uniform throughout the steel, it is cooled in air to room temperature. During cooling, martensite forms. Stresses are low. Both mar-quenching and austempering produce high strength. In mar-quenching, rapid cooling is interrupted just above the martensitic transformation temperature, which varies according to the steel's composition. The work is held in a constant-temperature bath until this temperature is equalized throughout the piece. Then it is cooled to room temperature and tempered in the usual manner. No bainite is allowed to form. Maximum hardness is the final result.

In austempering, the piece is quenched in a fixed-temperature bath and held at this temperature (500° to 750° F. depending on the steel) until the austenite completely transforms to bainite and the hardening transformation is complete. This process involves less total time (no additional tempering is needed) and the resulting bainite structure has a higher level of toughness for a given hardness.

The S-curve for austempering as shown in FIG. 7, reveals the similarities between mar-quenching and austempering. Here too, the steel or cast iron material must be austenitized and then quenched in a salt bath at a temperature above the Ms point. In austempering, the part must be held just above the Ms point at a constant temperature until austenite completely transforms to bainite.

Bainitic transformational stresses are lower than those developed during martensitic transformation. A bainitic structure imparts greater toughness to the part than does a martensitic structure tempered to an equivalent hardness. The steel is then either air cooled or water quenched without further structural change, since transformation has already been completed.

The article entitled "Salt Bath Austempering and Martempering" appearing in the publication "Machinery" for June, 1969 and written by Quentin D. Mehrkam restricts the use of martempering (mar-quenching as used herein) to carbon steels under one-half inch and to alloy steels under six inches. It further restricts the use of the austempering process or technique to carbon steels under ⅜ inch and to alloy steels under two inches.

Prior to the present invention the decision to use austempering or mar-quenching in any given hot salt quenching application depended on several factors including size of sections to be handled, hardness desired, physical properties desired and degree of distortion permitted. With the present invention the size of sections to be handled is not a critical factor thus permitting the austempering or mar-quenching techniques to be used with workpieces of large cross-sections.

When weighing these factors in relation to each other, the choice of one process or the other is often easy to make; however in many applications it has been impossible to rapidly move the workpiece from the heating furnace to the cooling station in the available time thus making time of the essence. This has detracted from the use of the austempering and mar-quenching techniques for large workpieces in particular since the workpiece is cooled below the $A_1$ temperature thereby limiting the practical use of the isothermal transformation process to those metals whose mass, geometry and/or chemical composition permit transport in the times required by conventional mechanical devices as explained previously.

The use of the present invention is illustrated by the following examples:

EXAMPLE I

In the case of bulldozer blade edges, where the workpiece may be larger than 2½inches × 15 inches × 14 feet, manufactured from steel alloys in the range from 10B30 steel alloy to 15B30 steel alloy, it has not been practical to obtain a very desirable near 100% bainite structure, due to the mass, large geometry, and chemical composition of the blade edges and to the inability of conventional transport apparatuses to move the workpiece from the heat source to the quench or isothermal transformation source, fast enough to avoid cooling of the workpiece to below the $A_1$ temperature before entering the quench.

To achieve the desired near 100% bainitic structure in the aforementioned workpieces, an insulated box or sleeve 44 was made to keep the $\Delta_T$ between the workpiece W and the atmosphere inside the insulated box 44, small enough to prevent cooling of the workpiece W below the $A_1$ during transport in the sleeve 44 from a salt bath heat treating source 12 to a brine quench 14, and from the brine quench 14, to a salt bath 16 set at the proper temperature for isothermal transformation to occur. In this case, the transport of the sleeve 44 containing the workpiece W was performed by a programmed mobile control robot as shown in FIG. 1. The microstructure of the workpiece W shows a near 100° bainitic structure in the aforementioned workpiece made of 15B30 alloy.

EXAMPLE II

In the case of circular saw blades, where the workpiece may be very thin and have little mass and manufactured from 1050, 1060 or 1075 carbon steels as well as some specialty steels and tool steels, it is often desirable to achieve an as-quenched hardness high enough to allow a press temper operation to assure straightness of the finished product. It has been practical in the case of Specialty Sharon Steels to affect isothermal transformation to achieve desired hardnesses by transporting the workpiece via a conventional mechanism. To reduce costs, the saw blade industry is now going to alloys such as 1050, 1060, and 1075 carbon steels, which are less expensive. The conventional transporting of these parts from their heating source to the quenching source is both economically and metallurgically undesirable. In these cases it has been demonstrated that excellent results are obtained by enclosing the workpieces in an insulating sleeve 44' and supplying through the use of electrical heat input coils 110, 112 enough B.T.U.'s or energy to prevent the temperature of the workpieces from falling below the $A_1$ temperature during transport. The resulting products are far superior and more desirable from an economic and metallurgical standpoint than products manufactured without using the present invention including the insulated sleeve 44'.

EXAMPLE III

In the case of hand tool files, the final products must achieve maximum hardness throughout the workpiece and retain a desired geometry. Conventional transporting mechanisms which do not maintain the temperature above the $A_1$, cause cooling of some section of the workpiece during transport. This undesirable cooling causes distortion in the geometry, creating a less desirable product. By employing the present invention and transferring the parts in an insulated container or sleeve 44', which is provided with reflectors 114 to reflect the radiating heat from the workpiece back into the workpiece during transport, thus, keeping the workpieces temperature above the $A_1$ during transport, results in a far superior distortion free product or workpiece.

EXAMPLE IV

Figure 9:
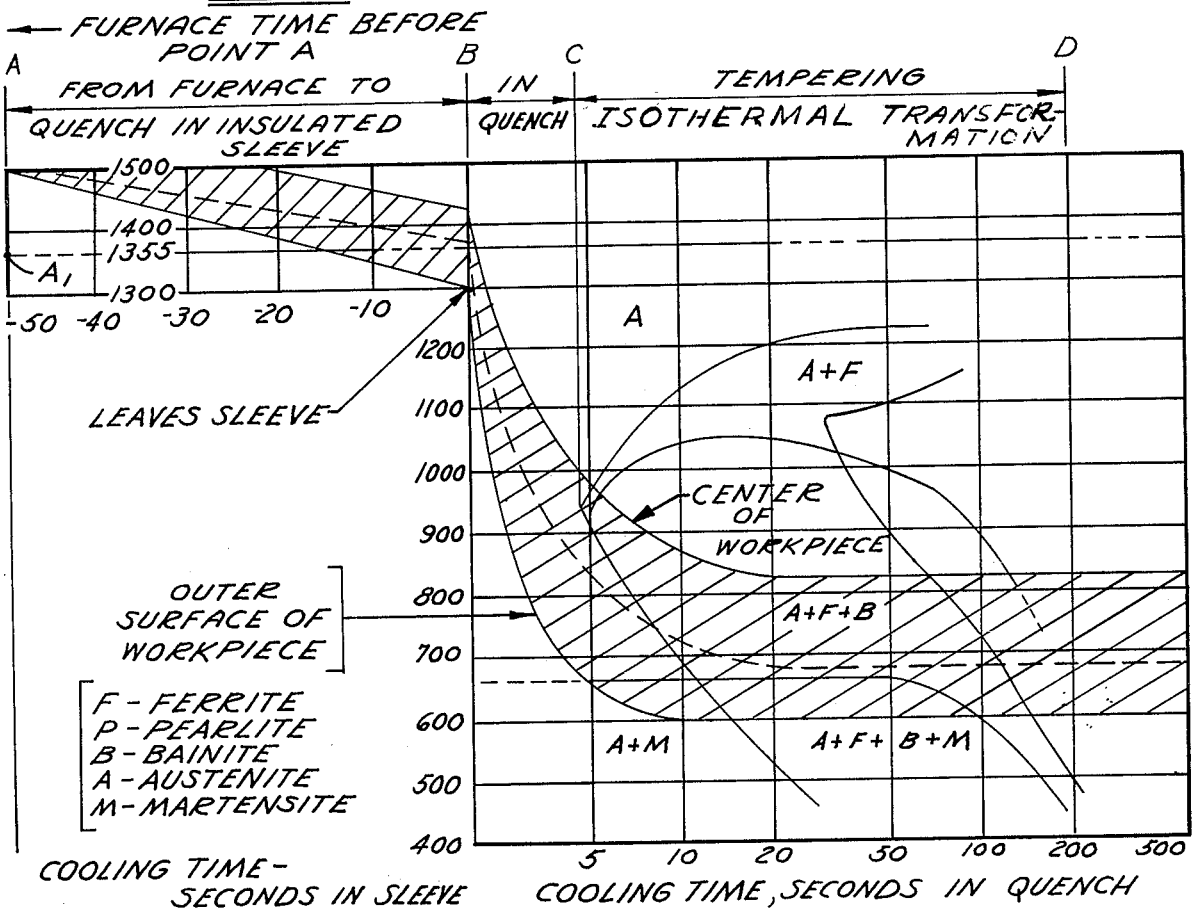
FIG. 9 is a T-T-T Diagram modified by using the present invention with a ferrous metal.

FIG. 9 shows the actual T-T-T Transformation Diagram for a workpiece measuring 12 inches × 12 inches × 30.125 inches made from 15B36 alloy steel containing 0.36 carbon, 1.45 manganese and 0.25 silicon. It has an $A_1$ temperature of 1355° F.; is austenitized in the heat treating furnace at 1550° F.; and has an $Ac_3$ temperature of 1470° F.

FIG. 9 has points A, B, C and D shown thereon. Prior to reaching point A where the workpiece was transferred to the insulated sleeve 44, the workpiece was austenitized in the heat treating furnace 14. The workpiece remains in the sleeve 44 between points A and B. The left part of the diagram shows that the temperature of the workpiece loses some heat but remains above the $A_1$ temperature. The horizontal scale between points A and B indicate cooling time in the sleeve measure in seconds and for purposes of illustration a minus sign (−) is shown in front of the seconds since it took 50 seconds to move the workpiece to point B where the workpiece at the $A_1$ temperature leaves the sleeve at the quench station 14 and transformation begins. The workpiece remains in the quench for about 5 seconds until the temperature of the workpiece measures <900° F. The workpiece reenters the sleeve at point C with a temperature slightly greater than 600° F. and is transferred to the tempering station 16 which has a temperature of ≃600° F. where the final isothermal transformation of the workpiece takes place between points C and D. After transformation has occurred the workpiece was tested and the following are the results:

Actual
Sample Data
Part Size 2" × 12" × 30⅛"

| | Pounds | #/Sq. In. |
|---|---|---|
| Yield | 35300 | 176500 |
| Ultimate Strength | 42000 | 210000 |
| | In 2" | % |
| Elevation | .22 | 11.0 |

| | |
|---|---|
| Area | .200 |
| Reduced Area | .1244 |
| Reduced Dimensions | .398 |
| % Reduction | 37.9 |

| Brinell Hardness | |
|---|---|
| .505 | 11" |
| 2 | 477 |
| 3 | 444 |
| 4 | 430 |
| 5 | 444 |
| 6 | 444 |
| 7 | 430 |
| 8 | 430 |
| 9 | 444 |
| 10 | 444 |
| 11 | 430 |

-continued

| | |
|---|---|
| 11.495 | 444 |

Microstructure was judged to be predominantly Bainite with occasional instances of ferrite.

In the case of non-ferrous metals such as aluminum and titanium, the practice of heat treating involves the raising of the metal temperature to above the transformation temperature and for continuity herein, the $A_1$ temperature refers also to the solution treating of non-ferrous metals instead of austenitizing of ferrous metals. The non-ferrous metal workpiece after obtaining a solid solution in the solution treating stage, can then be encapsulated during transport to hold the workpiece at the solution treating transformation temperature prior to quench.

I claim:

1. In a method of heat treating a metal workpiece of a character such that the time-temperature-transformation or T-T-T diagram defines an isothermal transformation curve in which the nose of the curve is so closely adjacent the ordinate of the T-T-T diagram as to require entry of the workpiece into a cooling medium at a temperature which is substantially at least the solution treating transformation temperature, the steps of: heating the metal workpiece at a heating station to a temperature above the solution treating transformation temperature of the metal workpiece and holding said temperature until the workpiece is formed into a homogeneous solid solution; removing the workpiece from the heating station and immediately enclosing the workpiece in a generally closed container; transporting the container enclosing the workpiece to a cooling station while maintaining the temperature of the workpiece in the container above the solution treating transformation temperature during the period of time required to physically transport the container and the workpiece therein from the heating station to said cooling station; removing the workpiece from the container and immediately inserting the workpiece which still has a temperature above the solution treating transformation temperature into the cooling station; at said cooling station isothermally transforming the workpiece by cooling the workpiece to the desired mixed solids; and thereafter removing the workpiece from the cooling station.

2. The method of heat treating as defined in claim 1 as applied to ferrous metals including the steps of again enclosing the workpiece in the container immediately upon the removal of the workpiece from the cooling station; transporting the container with the workpiece therein to an austempering station while retaining the workpiece at a temperature above the Ms; removing the workpiece from the container and immediately inserting the workpiece into the austempering station where the workpiece is austempered to the required metallurgical properties.

3. The method of heat treating as defined in claim 1 as applied to non-ferrous metals including the steps of enclosing the workpiece in the container immediately upon removal of the workpiece from the cooling station; transporting the container with the workpiece therein to an aging station; removing the workpiece from the container and immediately inserting the workpiece into the aging station where the workpiece is aged to the required metallurgical properties.

4. The method of heat treating defined in claim 1 including the step of supplying supplement heat to the container for maintaining the temperature of the workpiece in the container above the solution treating transformation temperature as the container with the workpiece is transported between the heating and cooling stations.

5. The method of heat treating defined in claim 1 including the step of supplying supplemental energy to the interior of the container for maintaining the temperature of the workpiece in the container above the solution treating transformation temperature as the container with the workpiece is transported between the heating and cooling station.

6. The method of heat treating defined in claim 1 including the step of reflecting the heat radiated from the workpiece when in the container back into the workpiece as the container is moved between the heating and cooling stations to maintain the temperature of the workpiece above the solution treating transformation temperature.

7. The method of heat treating as defined in claim 1 wherein the solution treating transformation is carried out in a molten salt bath at the heating station.

8. The method of heat treating as defined in claim 1 wherein the isothermal transformation is carried out in a brine solution at the cooling station.

9. The method of heat treating as defined in claim 2 wherein the austempering of the workpiece is carried out in a molten salt bath at the heating station.

10. The method of heat treating as defined in claim 3 wherein the heating is carried out in a molten salt bath at the heating station.

11. The method of heat treating as defined in claim 2 wherein the isothermal transformation is carried out in a brine solution at the cooling station.

12. The method of heat treating as defined in claim 3 wherein the isothermal transformation is carried out in a brine solution at the cooling station.

13. The method of heat treating as defined in claim 2 wherein the tempering of the workpiece takes place in a molten salt solution at the tempering station.

14. The method of heat treating as defined in claim 3 wherein the aging of the workpiece takes place in a molten salt solution at the aging station.

15. The method of heat treating as defined in claim 1 as applied to ferrous metals using the austempering technique.

16. The method of heat treating as defined in claim 1 as applied to ferrous metals using the marquenching technique.

17. The method of heat treating as defined in claim 1 as applied to non-ferrous metal using the solution treating and aging technique.

18. The method of heat treating as defined in claim 1 as applied to aluminum and alloys thereof using the solution treating and aging technique.

19. The method of heat treating as defined in claim 1 as applied to titanium and alloys thereof using the solution treating and aging technique.

20. The method of heat treating defined in claim 4 wherein the supplemental heating source is supplied by an electrical heater or coil.

21. The method of heat treating defined in claim 4 wherein the supplemental heating source is supplied by a fuel fired radiant tube.

22. The method of heat treating defined in claim 4 wherein the supplemental heating source is supplied by a direct fired burner.

23. In a method of heat treating a metal workpiece of a character such that the time-temperature-transformation or T-T-T diagram defines an isothermal transformation curve in which the nose of the curve is so closely adjacent the ordinate of the T-T-T diagram as to require entry of the workpiece into a cooling medium at a temperature which is substantially at least the solution treating transformation temperature, the steps of: heating the ferrous metal workpiece at a heating station to a temperature above the austenitizing temperature of the workpiece and holding said temperature until the workpiece is fully austenitized into a homogeneous solid solution; removing the workpiece from the heating station and immediately enclosing the workpiece in a container; transporting the container and the enclosed workpiece to a cooling station while maintaining the temperature of the workpiece in the container above the austenitizing temperature during the period of time required to physically transport the container and the workpiece therein from the heating station to the cooling station; removing the workpiece from the container and immediately inserting the workpiece which still has a temperature above the austenitizing temperature into the cooling station; at said cooling station isothermally transforming the workpiece by cooling the workpiece to the desired mixed solids; and thereafter removing the workpiece from the cooling station.

24. The method of heat treating as defined in claim 23 including the steps of again enclosing the workpiece in the container immediately upon removal thereof from the cooling station; transporting the container with the workpiece therein to a tempering station; removing the workpiece from the container and immediately inserting the workpiece into the tempering station where the workpiece is tempered to obtain the required metallurgical properties.

25. The method of heat treating defined in claim 23 including the step of supplying supplemental heat to the container to maintain the temperature of the workpiece above the austenitizing temperature during transport of the container-enclosed workpiece between the heating and cooling stations.

26. The method of heat treating defined in claim 23 including the step of supplying supplemental energy to the interior of the container to maintaining the temperature of the workpiece above the austenitizing temperature as the container with the workpiece is transported between the heating and cooling system.

27. The method of heat treating defined in claim 23 including the step of reflecting the heat radiated from the workpiece when in the container back into the workpiece when the container is moved between the heating and cooling stations thereby maintaining the temperature of the workpiece above the austenitizing temperature.

28. The method of heat treating the ferrous metal workpiece as defined in claim 23 using the austempering technique.

29. The method of heat treating the ferrous metal workpiece as defined in claim 23 using the mar-quenching technique.

30. In a method of heat treating a metal workpiece of a character such that the time-temperature-transformation or T-T-T diagram defines an isothermal transformation curve in which the noze of the curve is so closely adjacent the ordinate of the T-T-T diagram as to require entry of the workpiece into a cooling medium at a temperature which is substantially at least the solution treating transformation temperature, the steps of:

(1) positioning an open-bottomed insulating container over a heating station containing a workpiece at a temperatue above the solution treating transformation temperature of the workpiece;
(2) upwardly withdrawing the workpiece at said temperature from said heating station into said container;
(3) jointly laterally moving said container and the enclosed workpiece into vertical alignment with a cooling station while retaining said workpiece at substantially said temperature;
(4) downwardly moving said workpiece relative to said container and relative to said cooling station to insert the workpiece into the cooling station without allowing the temperature of the workpiece to drop below said transformation temperature; and
(5) isothermally transforming said workpiece at said cooling station.

* * * * *